US008650906B2

(12) United States Patent
Price et al.

(10) Patent No.: US 8,650,906 B2
(45) Date of Patent: Feb. 18, 2014

(54) SYSTEM AND METHOD FOR RECOVERING AND LIQUEFYING BOIL-OFF GAS

(75) Inventors: Brian C. Price, Plano, TX (US); Randal J. Winkler, Overland Park, KS (US)

(73) Assignee: Black & Veatch Corporation, Overland Park, KS (US)

( * ) Notice: Subject to any disclaimer, the term of this patent is extended or adjusted under 35 U.S.C. 154(b) by 1303 days.

(21) Appl. No.: 11/789,642

(22) Filed: Apr. 25, 2007

(65) Prior Publication Data

US 2008/0264076 A1 Oct. 30, 2008

(51) Int. Cl.
*F25J 1/00* (2006.01)
*F25B 41/04* (2006.01)

(52) U.S. Cl.
USPC ..... 62/611; 62/205

(58) Field of Classification Search
USPC ..... 62/611, 612, 613, 48.2, 643, 115, 86, 62/205, 222, 217
See application file for complete search history.

(56) References Cited

U.S. PATENT DOCUMENTS

| | | | | |
|---|---|---|---|---|
| 3,596,472 | A | 8/1971 | Streich | |
| 3,915,680 | A | 10/1975 | Crawford et al. | |
| 3,932,154 | A * | 1/1976 | Coers et al. | 62/612 |
| 4,033,735 | A | 7/1977 | Swenson | |
| 4,036,028 | A | 7/1977 | Mandrin | |
| 4,157,904 | A | 6/1979 | Campbell et al. | |
| 4,180,986 | A | 1/1980 | Shaw | |
| 4,278,457 | A | 7/1981 | Campbell et al. | |
| 4,311,496 | A | 1/1982 | Fabian | |
| 4,664,686 | A | 5/1987 | Pahade et al. | |
| 4,878,932 | A | 11/1989 | Phade et al. | |
| 5,051,120 | A | 9/1991 | Pahade et al. | |
| 5,182,920 | A | 2/1993 | Matsuoka et al. | |
| 5,379,597 | A | 1/1995 | Howard et al. | |
| 5,398,497 | A | 3/1995 | Suppes | |
| 5,442,924 | A | 8/1995 | Tsai et al. | |
| 5,502,972 | A | 4/1996 | Howard et al. | |
| 5,520,724 | A | 5/1996 | Bauer et al. | |
| 5,596,883 | A | 1/1997 | Bernhard et al. | |
| 5,657,643 | A | 8/1997 | Price | |
| 5,771,712 | A | 6/1998 | Campbell et al. | |
| 5,791,160 | A * | 8/1998 | Mandler et al. | 62/611 |
| 5,950,453 | A * | 9/1999 | Bowen et al. | 62/612 |
| 5,980,846 | A | 11/1999 | Tatani et al. | |
| 6,023,942 | A | 2/2000 | Thomas et al. | |
| 6,035,651 | A * | 3/2000 | Carey | 62/115 |
| 6,053,008 | A | 4/2000 | Arman et al. | |
| 6,070,430 | A | 6/2000 | McNeil et al. | |
| 6,085,546 | A | 7/2000 | Johnston | |

(Continued)

FOREIGN PATENT DOCUMENTS

| | | |
|---|---|---|
| JP | 2000018049 | 1/2000 |
| JP | 2002005398 | 1/2002 |

OTHER PUBLICATIONS

Gas Processor Suppliers Association (GPSA) Engineering Databook, Section 16 entitled "Hydrocarbon Recovery" p. 16-13 through 16-20, 12th Ed. (copyright 2004).

*Primary Examiner* — John Pettitt
*Assistant Examiner* — Ignacio E Landeros
(74) *Attorney, Agent, or Firm* — Hovey Williams LLP

(57) ABSTRACT

A system and process to re-liquefy boil-off liquid natural gas in varied amounts by a process using a screw compressor having an effective compression range from about 10 to about 100 percent of its rated capacity.

16 Claims, 1 Drawing Sheet

(56) References Cited

U.S. PATENT DOCUMENTS

| | | | | |
|---|---|---|---|---|
| 6,105,390 | A | 8/2000 | Bingham et al. | |
| 6,260,380 | B1 | 7/2001 | Arman et al. | |
| 6,266,977 | B1 | 7/2001 | Howard et al. | |
| 6,295,833 | B1 * | 10/2001 | Hoffart et al. | 62/613 |
| 6,311,516 | B1 | 11/2001 | Key et al. | |
| 6,330,811 | B1 | 12/2001 | Arman et al. | |
| 6,367,286 | B1 | 4/2002 | Price | |
| 6,427,483 | B1 | 8/2002 | Rashad et al. | |
| 6,438,994 | B1 * | 8/2002 | Rashad et al. | 62/613 |
| 6,662,589 | B1 | 12/2003 | Roberts et al. | |
| 6,725,688 | B2 * | 4/2004 | Elion et al. | 62/612 |
| 6,915,662 | B2 | 7/2005 | Wilkinson et al. | |
| 6,925,837 | B2 | 8/2005 | Eaton | |
| 7,051,553 | B2 | 5/2006 | Mak et al. | |
| 7,069,744 | B2 | 7/2006 | Patel et al. | |
| 7,100,399 | B2 | 9/2006 | Eaton | |
| 7,152,428 | B2 | 12/2006 | Lee et al. | |
| 7,216,507 | B2 | 5/2007 | Cuellar et al. | |
| 7,266,975 | B2 * | 9/2007 | Hupkes et al. | 62/612 |
| 7,310,972 | B2 | 12/2007 | Yoshida et al. | |
| 7,357,003 | B2 | 4/2008 | Ohara et al. | |
| 7,484,385 | B2 | 2/2009 | Patel et al. | |
| 7,614,241 | B2 * | 11/2009 | Mostello | 62/48.2 |
| 7,713,497 | B2 | 5/2010 | Mak | |
| 7,818,979 | B2 | 10/2010 | Patel et al. | |
| 2003/0046953 | A1 * | 3/2003 | Elion et al. | 62/612 |
| 2004/0159122 | A1 | 8/2004 | Patel et al. | |
| 2005/0005635 | A1 | 1/2005 | Le Metais | |
| 2005/0056051 | A1 * | 3/2005 | Roberts et al. | 62/612 |
| 2005/0204625 | A1 * | 9/2005 | Briscoe et al. | 48/127.3 |
| 2006/0260358 | A1 * | 11/2006 | Kun | 62/643 |
| 2007/0231244 | A1 | 10/2007 | Shah et al. | |
| 2008/0264076 | A1 | 10/2008 | Price et al. | |
| 2009/0205367 | A1 | 8/2009 | Price | |
| 2010/0132405 | A1 * | 6/2010 | Nilsen | 62/611 |
| 2012/0090324 | A1 | 4/2012 | Rosetta et al. | |

* cited by examiner

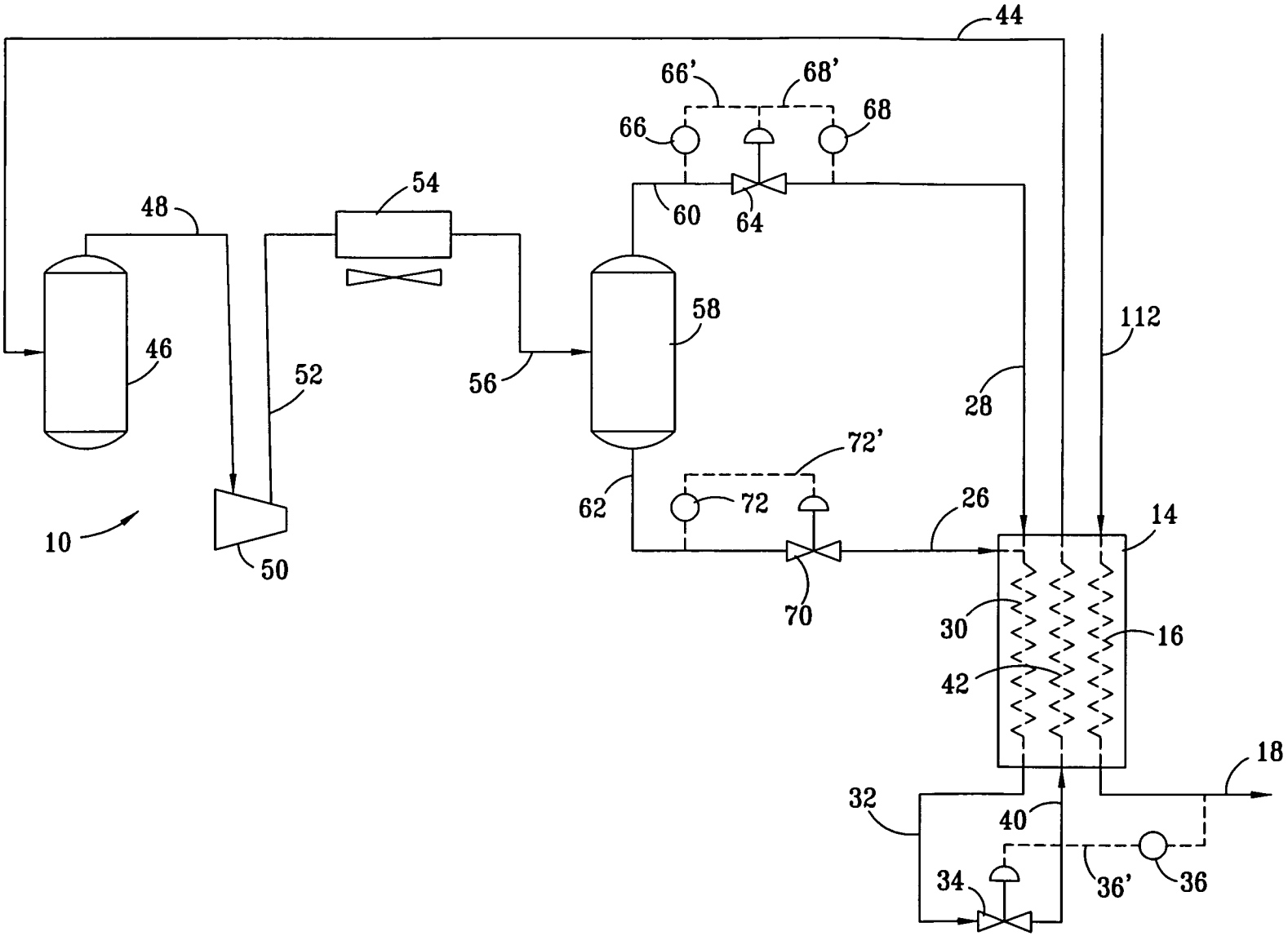
10
44
112
14
16
18
36
36'
28
26
30
42
40
34
32
68
68'
64
66'
66
60
58
62
72'
70
72
56
54
52
50
48
46

SYSTEM AND METHOD FOR RECOVERING AND LIQUEFYING BOIL-OFF GAS

FIELD OF THE INVENTION

During the production, transportation and handling of a liquefied natural gas, boil-off gas is released from the body of liquefied natural gas (LNG) at various points. This boil-off gas is a valuable product and is readily used as LNG if it can be reclaimed and re-liquefied. The present invention relates to a method and apparatus for recovering and liquefying boil-off gas.

BACKGROUND OF THE INVENTION

In many parts of the world abundant supplies of natural gas are found in areas where there is little or no demand for the natural gas. This natural gas is a valuable product if available at many market places in the world. Accordingly, various ways of transporting this natural gas to areas having a market place have been considered. In some instances pipelines have been used but in other instances the distances are prohibitive for use of pipelines.

In such instances, the natural gas has been either converted to a liquid product by processes such as the Fischer-Tropsch process or made into a liquid by natural gas liquefaction processes. Such processes are well known and constitute mixed refrigerant processes such as shown in U.S. Pat. No. 4,033,735 (the '735 patent) issued Jul. 5, 1977 to Leonard K. Swenson and assigned to J. F. Pritchard and Company. A further process of this type is shown in U.S. Pat. No. 5,657,643 (the '643 patent) issued Aug. 19, 1997 to Brian C. Price and assigned to The Pritchard Corporation.

Other processes, such as cascade refrigerant processes and the like are also known for such liquefaction processes. Such processes are designed, however, for the liquefaction of large volumes of natural gas and typically comprise systems wherein a refrigerant or a plurality of refrigerants are compressed by centrifugal compressors, typically turbine compressors, which may be driven by light hydrocarbon gas fueled turbines or electric motors and thereafter passed to cooling and separation. The separated refrigerant components may then be recombined and passed to a refrigeration section. The refrigerant components or other refrigerants may be passed to the refrigeration section with or without mixing and the like.

A wide variety of processes have been used to liquefy natural gas. In the processes discussed in the patents referred to above, a mixed refrigerant is passed through a heat exchange path and cooled in a refrigeration zone, flashed to further cool the stream which is then allowed to evaporate progressively as it moves through the refrigeration section to produce a vaporous refrigerant with the refrigeration section being cooled by the heat of evaporation of the mixed refrigerant as it moves through the refrigeration section. This passage of the vaporizing refrigerant serves to cool the mixed refrigerant as it passes through the refrigeration section with the natural gas being liquefied by passing it through the refrigeration section, optionally removing it from the refrigeration section at some intermediate point along its cooling path to remove heavier materials, such as $C_3$ and heavier hydrocarbons and the like, from the natural gas and then passing the natural gas back into the refrigeration section for further cooling to produce an at least a liquefied LNG stream. This liquefied LNG stream may be cooled further by flashing gas from the body of the liquefied natural gas if desired to further reduce the temperature of the LNG. This flash gas is typically boil-off gas and is approximately of the same composition as the rest of the LNG. Clearly the amount of boil-off gas which is flashed in this fashion is quite variable depending upon the amount of LNG produced. The boil-off gas so produced may be re-liquefied, passed to fuel and the like. It is very suitable for use as a stream for return to the refrigeration section but such requires compression and other steps which may not be available at unloading facilities and the like in all instances. Boil-off gas is lost during operations such as the unloading of tanker vessels, the storage of natural gas in insulated tanks or underground storage areas and the like where re-liquefaction facilities may not be available.

The amount of boil-off gas which is lost can be widely variable and as a result it has been difficult to suitably recover and re-liquefy boil-off gas in areas in which liquefaction facilities do not exist, such as in unloading areas for LNG tankers, for the passage of LNG into storage areas such as tanks and underground storage and the like. In many instances boil-off gas is also released as the LNG is removed from storage for re-gasification to produce gas to feed a pipeline.

This valuable boil-off gas resource is suitable for re-liquefaction but is not normally used for such purposes except possibly in areas where liquefaction facilities exist. Accordingly, since this boil-off gas represents a valuable resource a continuing effort has been directed to methods for the recovery of the boil-off gas.

SUMMARY OF THE INVENTION

It has been found that boil-off gas may be recovered and liquefied by a system consisting essentially of a refrigeration section including a first heat exchange path having a refrigerant inlet and a cooled refrigerant outlet to a second heat exchange path having a reduced pressure refrigerant inlet and a reduced pressure refrigerant outlet positioned for a reduced pressure refrigerant flow countercurrent to the first heat exchange path for the refrigerant and a third heat exchange path having a boil-off gas inlet and a liquefied boil-off gas outlet countercurrent to the second heat exchange path for the reduced pressure refrigerant to liquefy a boil-off gas; a screw compressor having an inlet in fluid communication with the reduced pressure refrigerant outlet and a high pressure refrigerant outlet and adapted to produce a compressed refrigerant; a cooler in fluid communication with the high pressure refrigerant outlet and having a compressed refrigerant inlet and a cooled compressed refrigerant outlet; a separator having a separator inlet in fluid communication with the cooled compressed refrigerant outlet, a separator liquid refrigerant outlet and a separator gaseous refrigerant outlet; a first line in fluid communication with the separator gaseous refrigerant outlet and the refrigerant inlet to the refrigeration section and including a pressure controller; and, a second line in fluid communication with the separator liquid refrigerant outlet and the refrigerant inlet to the refrigeration section and including a flow controller.

The invention further comprises an improvement in a system consisting essentially of: a refrigeration section including a first heat exchange path having a refrigerant inlet and a cooled refrigerant outlet, a second heat exchange path having a reduced pressure refrigerant inlet and a reduced pressure refrigerant outlet positioned for a reduced pressure refrigerant flow countercurrent to the first heat exchange path for the refrigerant and a third heat exchange path having a boil-off gas inlet and a liquefied boil-off gas outlet for a boil-off gas countercurrent to the second heat exchange path for the reduced pressure refrigerant to liquefy a boil-off gas; a turbine compressor having an inlet in fluid communication with the reduced pressure outlet and a high pressure refrigerant outlet and adapted to produce a compressed refrigerant; a cooler in fluid communication with the high pressure refrigerant outlet and having a compressed refrigerant inlet and having a cooled compressed refrigerant outlet; a separator having a separator inlet in fluid communication with the cooled compressed refrigerant outlet, a separator liquid refrigerant outlet and a separator gaseous refrigerant outlet; and, a pump for pumping liquid refrigerant from the separator liquid refrigerant outlet from the separator to the refrigerant inlet to the refrigeration section for mixture with gaseous refrigerant from the separator gaseous refrigerant outlet, the improvement comprising: a screw compressor having an operating range from about 10 to about 100 percent of its rated capacity; and a pressure controller positioned in a first line in fluid communication with the separator gaseous refrigerant outlet and the refrigerant inlet; and, a flow controller positioned in a second line in fluid communication with the separator liquid refrigerant outlet and the refrigerant inlet to regulate flow through the first and second lines.

The invention further includes a method for recovering liquefying boil-off gas, the method consisting essentially of: recovering and passing a varying quantity of a boil-off gas to a refrigeration section to produce a liquefied boil-off gas stream and a gaseous refrigerant stream; passing the gaseous refrigerant stream to a variable rate compressor having an operating range from about 10 to about 100 percent of the compressor's rated capacity to produce a compressed refrigerant stream; cooling the compressed refrigerant stream to produce a stream of mixed liquid and gaseous refrigerant; separating the liquid and gaseous refrigerant in a separation zone; passing the gaseous refrigerant to the refrigeration section through a first line at a lower pressure than a pressure in the separation zone; passing the liquid refrigerant through a second line to the refrigeration zone; and, adjusting the pressure in the first line to control the amount of liquid refrigerant passed through the second line.

BRIEF DESCRIPTION OF THE FIGURE

The FIGURE is a schematic diagram of the process of the present invention.

DESCRIPTION OF PREFERRED EMBODIMENTS

In the FIGURE a process is shown for the collection and liquefaction of varying quantities of boil-off gas. In the larger facilities, typically centrifugal compressors are used to compress refrigerant. This requires a relatively steady flow volume of refrigerant since such compressors typically have the capability of operating between about 75 to about 100 percent of their rated capacity.

The quantities of boil-off gas which are released for compression may vary widely, such as the quantities of the gas released during unloading of a LNG vessel or the transfer of LNG from one tank to another or during gasification operations to deliver LNG converted to natural gas to pipelines at a desired temperature and pressure and the like. While this quantity of boil-off gas may vary, it is highly desirable that a method be available to collect and re-liquefy it.

The present invention provides a process which has a much wider operating range than previously used processes. In a process 10 as shown in the FIGURE, a boil-off gas stream is passed through a line 12 to a refrigeration zone 14. The boil-off gas is passed through a heat exchange path 16 to liquefy a boil-off gas stream produced through a line 18.

The liquefaction in vessel 14 is achieved by passing a refrigerant through lines 26 and 28 to combination in a refrigeration zone 14. The recombination can occur prior to injecting the mixed stream into refrigeration section 14 if desired. The mixed refrigerant passes through a heat exchange path 30 in which it is chilled and may be at least partially liquid. This stream is passed through a line 32 through an expansion valve 34 to produce an expanded refrigerant stream which has been radically cooled by the expansion and which passes through a line 40 back into a heat exchange path 42 where it continuously evaporates as it passes back through heat exchanger 14. The amount of expansion required may be varied as determined by a temperature sensor 36 in a line 36' for sensing a temperature in a line 18 to control valve 34. The degree of flashing can readily be used to control the amount of liquefaction in line 18. The vaporized refrigerant is recovered through a line 44 and passed to a separator 46 from which a vaporous refrigerant stream is withdrawn and passed through a line 48 to a screw compressor 50.

Screw compressors are well known to those skilled in the art and can achieve the desired compression, i.e., up to about 650 psia. These compressors, however, have a much wider operation range than turbine compressors and can be effectively used for compression at volumes from about 10 percent to about 100 percent of their rated capacity.

The compressed refrigerant from screw compressor 50 is passed through line 52 to a cooler 54, which is shown as an air cooler, to produce a cooled, mixed refrigerant stream. The stream in line 56 will typically be a mixed stream of liquid and gaseous refrigerant and is passed to a separator 58. It is desirable to reconstitute the refrigerant (i.e., adjust the quantities of liquid and gaseous refrigerant) prior to passing it through heat exchange pathway 30. This is accomplished without the use of pumps by the use of a control valve 64 in a line 60 passing from a gaseous refrigerant outlet from separator 58 to combination with a liquid stream of refrigerant from a line 62. The pressure in this line is controlled by a pressure controller 66 in operative communication via a connection 66' with a control valve 64 in line 60 and by the use of a pressure control 68 in operative communication via a connector 68' with control valve 64 in line 28. The pressure in line 28 is reduced to a pressure below that in separator 58 so that liquid refrigerant flows through line 62 and a line 26 to combination with the stream in line 28. As mentioned previously, these streams can be combined prior to entering refrigeration section 14. The flow through line 62 is controlled by a pressure controller 72 which is connected via a line 72' with a flow control value 70 which regulates the flow through line 62 and through line 26. The combined streams from lines 26 and 28 are a reconstituted refrigerant which is then passed into refrigerant section 14 to produce the chilled refrigerant and the desired refrigeration of the natural gas as previously discussed.

By the use of this process the volume of refrigerant passed to refrigeration zone 14 can be varied widely dependent upon the quantity of boil-off gas supplied through line 12 and line 22. This process is much simpler than the processes normally used for large installations and can operate at more widely varied amounts of refrigerant. This allows the use of the process to liquefy boil-off gas in relatively minor and variable quantities up to substantial quantities without varying the process. Further the process does not require pumping to inject the liquid refrigerant into refrigeration vessel 14. The vessel can thus operate substantially continuously at radically varied flow rates. This is a significant advantage in comparison to previously known processes which primarily use centrifugal turbines to compress refrigerant. Further previous large installations have typically required the use of numerous pumps and controls to pass the reconstituted, mixed refrigerant into the refrigeration zone.

As will be noted, the subject process is a process primarily directed to an improvement in a mixed refrigerant process. Mixed refrigerants are well known to those skilled in the art, as described for instances at column 7, lines 14-36 of the "the 643 patent.

The mixed refrigerant is desirably selected from the group consisting of nitrogen and hydrocarbons containing from one to about five carbon atoms. Typically the refrigerant is mixed so that a desired refrigeration curve is achieved, as shown in FIG. 2 of the '643 patent. Such variations are known to those skilled in the art and constitute no part of the present invention which is directed to an improved process which permits the liquefaction of widely varying amounts of boil-off gas.

It is particularly undesirable to lose the boil-off gas since the boil-off gas has already been treated for the removal of acid gases, water, hydrocarbons heavier than about $C_3$ which could liquefy in refrigeration section 14 and the like. Desirably this gas is re-liquefied and combined with the LNG. The amount of boil-off gas from storage may vary as pressure in the storage vessel increases. When a selected pressure is reached or exceeded in the vessel, the amount of boil-off gas released from the vessel will be increased. This increased amount of boil-off gas may be passed to heat exchanger 14, liquefied by the present invention and returned as liquefied boil-off gas to the vessel thereby cooling the LNG in the vessel and reducing the pressure in the vessel or tank.

In many installations, the facilities for unloading, storage, re-gasification and the like are of substantial size and a continuing loss of boil-off gas occurs with the boil-off gas typically being passed to use as a fuel or other low value applications. By the process of the present invention such boil-off gas can be recovered, re-liquefied and produced as a valuable LNG product.

The system and process also provide for an increased capacity to accommodate larger flows of boil-off gas during tanker unloading and the like.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A system for recovering and liquefying a natural gas boil-off stream, the system comprising:

a refrigeration vessel including a first heat exchange path for cooling a stream of mixed refrigerant, the first heat exchange path having a refrigerant inlet and a cooled refrigerant outlet, a second heat exchange path for warming a cooled refrigerant stream, the second heat exchange path having a reduced pressure refrigerant inlet and a reduced pressure refrigerant outlet positioned such that the refrigerant in the second heat exchange path flows countercurrent to the refrigerant flowing through the first heat exchange path, and a third heat exchange path for liquefying a stream of boil-off gas, the third heat exchange path having a boil-off gas inlet and a liquefied boil-off gas outlet positioned such that the boil-off gas in the third heat exchange path flows countercurrent to the refrigerant flowing through the second heat exchange path; and a closed-loop refrigeration cycle comprising— a screw compressor having an inlet in fluid communication with the reduced pressure refrigerant outlet of the second heat exchange path and a high pressure refrigerant outlet for discharging a compressed refrigerant from the screw compressor;

a cooler for cooling the compressed refrigerant, the cooler having a compressed refrigerant inlet in fluid communication with the high pressure refrigerant outlet of the screw compressor and a cooled refrigerant outlet;

a refrigerant separator having a separator inlet in fluid communication with the cooled refrigerant outlet of the cooler, a separator liquid refrigerant outlet for discharging a stream of liquid refrigerant and a separator gaseous refrigerant outlet for discharging a stream of gaseous refrigerant;

a refrigerant vapor line in fluid communication with the separator gaseous refrigerant outlet, the refrigerant vapor line including a pressure controller disposed therein;

a refrigerant liquid line in fluid communication with the separator liquid refrigerant outlet, the refrigerant liquid line including a flow controller disposed therein, wherein the pressure controller disposed in the refrigerant vapor line is configured to adjust the flow rate of liquid refrigerant passing through the refrigerant liquid line;

a reconstituted refrigerant line for receiving and combining the vapor and liquid refrigerant streams from each of the refrigerant vapor and liquid lines, respectively, wherein the reconstituted refrigerant line is configured to discharge a combined stream of vapor and liquid refrigerant into the refrigerant inlet of the first heat exchange path of the refrigeration vessel; and an expansion valve having an inlet in fluid communication with the cooled refrigerant outlet of the first heat exchange path and an outlet in fluid communication with the reduced pressure refrigerant inlet of the second heat exchange path.

2. The system of claim 1 wherein the system includes a vapor-liquid separator having an inlet in fluid communication with the reduced pressure outlet of the second heat exchange path and a gaseous refrigerant outlet in fluid communication with the inlet to of the screw compressor.

3. The system of claim 2 wherein the cooler is a fan cooler.

4. The system of claim 1 wherein the pressure controller disposed in the refrigerant vapor line comprises a control valve and a pressure sensor connected to the control valve to control the pressure in the refrigerant vapor line to a selected pressure set point.

5. The system of claim 1 wherein the flow controller disposed in the refrigerant liquid line comprises a control valve and a flow sensor connected to the control valve to control the flow rate in the refrigerant liquid line to a selected flow rate.

6. The system of claim 1 wherein the screw compressor is configured to operate in an operating range of from about 10 to about 100 percent of its maximum rated capacity.

7. A method for liquefying a boil-off gas stream recovered from a liquefied natural gas (LNG) product, the method comprising:

(a) recovering a stream of boil-off gas;

(b) cooling and at least partially condensing the boil-off gas via indirect heat exchange with a mixed refrigerant stream in a refrigeration zone to provide a cooled boil-off stream;

(c) compressing at least a portion of the refrigerant stream withdrawn from the refrigeration zone with a refrigerant compressor;

(d) cooling and at least partially condensing at least a portion of the refrigerant compressed in step (c);

(e) separating the cooled refrigerant into a vapor phase refrigerant stream and a liquid phase refrigerant stream in a vapor-liquid separator;

(f) combining at least a portion of the vapor phase refrigerant stream with at least a portion of the liquid phase refrigerant stream to form a combined refrigerant stream, wherein the combining includes adjusting the pressure of the vapor phase refrigerant stream in a vapor refrigerant line originating from the vapor-liquid separator in order to control the flow rate of the liquid phase refrigerant stream in a liquid refrigerant line originating from the vapor-liquid separator;

(g) subsequent to step (f), cooling at least a portion of the combined refrigerant stream in a first heat exchange passageway to provide a cooled refrigerant stream;

(h) expanding at least a portion of the cooled refrigerant stream to provide an expanded refrigerant stream; and (j) introducing at least a portion of the expanded refrigerant stream into the refrigeration zone, wherein the expanded refrigerant stream is used to carry out at least a portion of the cooling of step (b).

8. The method of claim 7, wherein the combining of step (f) includes passing the liquid phase refrigerant stream from the vapor-liquid separator to the first heat exchange passageway without a pump.

9. The method of claim 7, wherein the adjusting is at least partially carried out using a pressure control valve disposed on a vapor line between the vapor-liquid separator and the refrigeration zone.

10. The method of claim 7, further comprising measuring the temperature of the boil-off gas stream cooled in step (b) and using the measured temperature to control the degree of expansion of the cooled refrigerant stream in step (h).

11. The method of claim 7, wherein the combining of step (f) occurs upstream of the refrigeration zone.

12. The method of claim 7, wherein the boil-off gas is recovered from an LNG loading or unloading facility, an LNG gasification unit, an LNG storage tank, a natural gas pipeline, a LNG tanker ship, or combinations thereof.

13. A method for liquefying a boil-off gas stream recovered from liquefied natural gas (LNG), the method comprising:

(a) cooling and at least partially condensing a boil-off gas stream via indirect heat exchange with a mixed refrigerant stream in a refrigeration zone to thereby provide a cooled boil-off gas stream and a warmed refrigerant stream;

(b) compressing at least a portion of the warmed refrigerant stream withdrawn from the refrigeration zone with a refrigerant compressor to provide a compressed refrigerant stream;

(c) cooling and at least partially condensing the compressed refrigerant stream to provide a cooled, two-phase refrigerant stream;

(d) separating the cooled, two-phase refrigerant stream into a vapor phase refrigerant stream and a liquid phase refrigerant stream in a refrigerant separator;

(e) withdrawing a vapor phase refrigerant stream from the upper portion of the refrigerant separator, wherein the withdrawing includes passing the vapor phase refrigerant stream through a pressure control valve;

(f) simultaneously with step (e), withdrawing a liquid phase refrigerant stream from the lower portion of the refrigerant separator, wherein said withdrawing of the liquid phase refrigerant stream is carried out in the absence of a pump;

(g) immediately subsequent to steps (e) and (f), combining at least a portion of the vapor phase refrigerant passed through the pressure control valve and at least a portion of the liquid phase refrigerant to form a reconstituted refrigerant stream, wherein the combining includes using the pressure control valve to adjust the pressure of the vapor phase refrigerant stream in order to control the flow rate of the liquid phase refrigerant stream;

(h) cooling the reconstituted refrigerant stream in a first heat exchange passageway of the refrigeration zone to provide a cooled combined refrigerant stream; and (i) expanding the cooled combined refrigerant stream to provide an expanded refrigerant stream, wherein at least a portion of the expanded refrigerant stream is used to carry out at least a portion of the cooling of step (a).

14. The method of claim 13, further comprising measuring the temperature of the cooled boil-off gas stream provided in step (a) and using the measured temperature to control the degree of expansion of the expanded refrigerant stream in step (i).

15. The method of claim 13, wherein the combining of step (g) occurs upstream of the refrigeration zone.

16. The method of claim 13, wherein the combining of step (g) occurs within the refrigeration zone.

* * * * *